US009557668B2

(12) United States Patent
Masuda et al.

(10) Patent No.: US 9,557,668 B2
(45) Date of Patent: Jan. 31, 2017

(54) TONER FOR DEVELOPING ELECTROSTATIC IMAGES

(71) Applicant: ZEON CORPORATION, Tokyo (JP)

(72) Inventors: Azusa Masuda, Tokyo (JP); Ryuji Ohta, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 14/770,544

(22) PCT Filed: Feb. 26, 2014

(86) PCT No.: PCT/JP2014/054742

§ 371 (c)(1),
(2) Date: Aug. 26, 2015

(87) PCT Pub. No.: WO2014/133032

PCT Pub. Date: Sep. 4, 2014

(65) Prior Publication Data

US 2016/0004176 A1 Jan. 7, 2016

(30) Foreign Application Priority Data

Feb. 28, 2013 (JP) ..... 2013-038269

(51) Int. Cl.

| | |
|---|---|
| ***G03G 9/087*** | (2006.01) |
| ***G03G 9/08*** | (2006.01) |
| ***G03G 9/097*** | (2006.01) |
| ***G03G 11/00*** | (2006.01) |

(52) U.S. Cl.

CPC ..... *G03G 9/0821* (2013.01); *G03G 9/08728* (2013.01); *G03G 9/08782* (2013.01); *G03G 9/09733* (2013.01); *G03G 11/00* (2013.01)

(58) Field of Classification Search

CPC ..... G03G 9/09733; G03G 9/08782; G03G 9/08795; G03G 9/08797; G03G 9/0821

USPC ..... 430/108.4

See application file for complete search history.

(56) References Cited

U.S. PATENT DOCUMENTS

| | | | | |
|---|---|---|---|---|
| 5,635,325 | A | 6/1997 | Inaba et al. | |
| 2012/0135344 | A1 | 5/2012 | Wada | |
| 2012/0328979 | A1* | 12/2012 | Yoshizaki ..... | G03G 9/0821 430/110.4 |

FOREIGN PATENT DOCUMENTS

| | | | |
|---|---|---|---|
| CN | 1117600 | A | 2/1996 |
| JP | 2005-315930 | A | 11/2005 |
| JP | 2006-215312 | A | 8/2006 |
| JP | 2007-72258 | A | 3/2007 |
| JP | 2008-224939 | A | 9/2008 |
| JP | 2011-215179 | A | 10/2011 |
| JP | 2012-78628 | A | 4/2012 |
| JP | 2012-118271 | A | 6/2012 |
| WO | 2013015787 | A1 | 1/2013 |

OTHER PUBLICATIONS

English Translation of International Preliminary Report on Patentability dated Sep. 11, 2015, issued in counterpart Application No. PCT/JP2014/054742. (6 pages).

International Search Report dated Apr. 15, 2014, issued in counterpart International Application No. PCT/JP2014/054742 (1 page).

* cited by examiner

*Primary Examiner* — Christopher Rodee

(74) *Attorney, Agent, or Firm* — Westerman, Hattori, Daniels & Adrian, LLP

(57) ABSTRACT

The present invention is to provide a toner which has an excellent balance between heat-resistant storage stability and low-temperature fixability and which is excellent in printing durability even under a wide range of temperature and humidity environments from a low temperature and low humidity environment to a high temperature and high humidity environment. Disclosed is a toner for developing electrostatic images, containing colored resin particles containing a binder resin, a colorant, a softening agent and a retention aid, and an external additive, wherein the retention aid is a copolymer of at least one of acrylic acid ester and methacrylic acid ester and at least one of acrylic acid and methacrylic acid, and wherein the copolymer has an acid value of 0.5 to 7 mgKOH/g, a weight average molecular weight Mw of 6,000 to 50,000, and a glass transition temperature of 60 to 85° C.

4 Claims, No Drawings

TONER FOR DEVELOPING ELECTROSTATIC IMAGES

TECHNICAL FIELD

The present invention relates to a toner for developing electrostatic images, which can be used for development in image forming devices using electrophotography, such as a copy machine, a facsimile machine and a printer.

BACKGROUND ART

In recent years, with the rapid development of high-speed electrophotographic laser printers and copy machines, there is an increasing demand for toners with better developability, transferability and low-temperature fixability. In the recent toner development, out of environmental considerations, low-temperature fixability is especially an essential factor since it can lead to decrease in power consumption.

Along with the expansion of the market, the environment of usage has increasingly diversified, and toners have been demanded to deliver stable performance in a wide range of environments, from a low temperature and low humidity environment to a high temperature and high humidity environment. Accordingly, the development of toners that can provide excellent durability in different environments and low-temperature fixability, has been studied.

For example, a polymerized toner is disclosed in Patent Literature 1, which is obtained by polymerizing a polymerizable composition that contains a polymerizable monomer, a colorant and a liquid polymer having a glass transition temperature of 0° C. or less. It is also disclosed that the toner is excellent in low-temperature fixability, environmental stability and printing durability and ensures good image reproducibility. In Patent Literature 2, it is disclosed that a toner manufactured from a toner composition in an aqueous medium, the toner composition containing a polymerizable monomer, a colorant, a polar resin and a fine powder material insoluble with styrene and the toner containing the polar resin in a specific amount and satisfying a specific relational expression between the acid value of the binder resin, the acid value of the polar resin and the acid value of an organic compound treating the surface of the fine powder material, is excellent in environmental stability and charging characteristics and is also capable of achieving a high-quality image, without causing image density irregularity, etc.

A yellow toner is disclosed in Patent Literature 3, which has toner particles obtained by polymerization of a polymerizable monomer composition containing a polymerizable monomer, a yellow pigment, a wax and two kinds of carboxyl group-containing resins, wherein the carboxyl group-containing resins are contained in specific amounts and the interfacial tension of styrene, the interfacial tension of the yellow pigment and the interfacial tensions of the carboxyl group-containing resins satisfy specific relational expressions. It is also disclosed that the yellow toner is excellent in low-temperature fixability, high in glossiness and tinting strength, and excellent in transparency. In Patent Literature 4, a toner containing toner particles obtained by granulation of a binder resin, an ester wax and a carboxyl group-containing vinyl resin in an aqueous medium is disclosed, wherein the SP value of the binder resin and the SP value of the carboxyl group-containing vinyl resin are in given ranges; the molecular weight and the molecular weight distribution of the carboxyl group-containing vinyl resin are in given ranges; and the content of the ester wax and the content of the carboxyl group-containing vinyl resin are in given ranges. It is also disclosed that the toner is able to prevent decrease in durability and contamination in fixing devices, as well as it is able to provide both low-temperature fixability and storage stability at high temperature.

However, the toners obtained by the methods disclosed in these patent literatures are difficult to satisfy, in response to the recent demand for high speed printing, both low fixing temperature and storage stability at high temperature concurrently and sufficiently. In addition, they are sometimes insufficient in printing durability under different environments.

CITATION LIST

Patent Literature 1: Japanese Patent Application Laid-Open (JP-A) No. 2005-315930

Patent Literature 2: JP-A No. 2008-224939

Patent Literature 3: JP-A No. 2011-215179

Patent Literature 4: JP-A No. 2012-78628

SUMMARY OF INVENTION

Technical Problem

An object of the present invention is to provide a toner which has an excellent balance between heat-resistant storage stability and low-temperature fixability and which is excellent in printing durability even under a wide range of temperature and humidity environments from a low temperature and low humidity environment to a high temperature and high humidity environment.

Solution to Problem

As a result of diligent research, the inventors of the present invention have found that the above-mentioned object can be achieved by incorporating, in colored resin particles constituting a toner for developing electrostatic images, a copolymer as a retention aid, which can be obtained by polymerizing a specific polymerizable monomer and which has an acid value, a weight average molecular weight and a glass transition temperature in specific ranges.

That is, according to the present invention, a toner for developing electrostatic images is provided, comprising colored resin particles containing a binder resin, a colorant, a softening agent and a retention aid, and an external additive, wherein the retention aid is a copolymer of at least one of acrylic acid ester and methacrylic acid ester and at least one of acrylic acid and methacrylic acid, and wherein the copolymer has an acid value of 0.5 to 7 mgKOH/g, a weight average molecular weight Mw of 6,000 to 50,000, and a glass transition temperature of 60 to 85° C.

In the present invention, the content of the copolymer is preferably 0.5 to 4 parts by mass, with respect to 100 parts by mass of the binder resin.

In the present invention, the softening agent is preferably a monoester compound which has a structure represented by the following formula (1) and a melting point of 60 to 75° C.:

$$R^1—COO—R^2 \qquad \text{Formula (1)}$$

wherein $R^1$ is a straight-chain alkyl group having 15 to 21 carbon atoms, and $R^2$ is a straight-chain alkyl group having 16 to 22 carbon atoms.

In the present invention, the monoester compound preferably has an acid value of 1.0 mgKOH/g or less and a hydroxyl value of 10 mgKOH/g or less.

Advantageous Effects of Invention

According to the present invention, by containing a retention aid which is a copolymer of acrylic acid ester and/or methacrylic acid ester and acrylic acid and/or methacrylic acid and which has an acid value, a weight average molecular weight and a glass transition temperature in specific ranges, a toner for developing electrostatic images can be provided, which has an excellent balance between heat-resistant storage stability and low-temperature fixability and which is able to exhibit excellent printing durability under all of a high temperature and high humidity (H/H) environment, a normal temperature and normal humidity (N/N) environment, and a low temperature and low humidity (L/L) environment.

DESCRIPTION OF EMBODIMENTS

The toner for developing electrostatic images according to the present invention contains colored resin particles containing a binder resin, a colorant, a softening agent and a retention aid, and an external additive, wherein the retention aid is a copolymer of at least one of acrylic acid ester and methacrylic acid ester and at least one of acrylic acid and methacrylic acid, and wherein the copolymer has an acid value of 0.5 to 7 mgKOH/g, a weight average molecular weight Mw of 6,000 to 50,000, and a glass transition temperature of 60 to 85° C.

Hereinafter, the toner for developing electrostatic images according to the present invention (hereinafter may be simply referred to as "toner") will be described.

The toner of the present invention contains colored resin particles containing a binder resin, a colorant, a softening agent and a specific retention aid, and an external additive.

Hereinafter, the method for producing the colored resin particles used in the present invention, the colored resin particles obtained by the production method, the method for producing the toner of the present invention using the colored resin particles, and the toner of the present invention will be described in order.

1. Method for Producing Colored Resin Particles

Generally, methods for producing colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method is preferable among the wet methods and is performed by the following processes.

(A) Suspension Polymerization Method (A-1) Preparation Process of Polymerizable Monomer Composition First, a polymerizable monomer, a colorant, a softening agent, a retention aid, and other additives such as a charge control agent, which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable into a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use a macromonomer as a part of the polymerizable monomer, since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular mass of 1,000 to 30,000. A preferable macromonomer is one capable of providing a polymer having a higher glass transition temperature (hereinafter may be referred to as "Tg") than a polymer obtained by the polymerization of the monovinyl monomer.

The macromonomer to be used is preferably in the range from 0.03 to 5 parts by mass, more preferably from 0.05 to 1 part by mass, with respect to 100 parts by mass of the monovinyl monomer.

In the present invention, to provide an excellent balance between heat-resistant storage stability and low-temperature fixability and excellent printing durability under a wide range of temperature and humidity environments to the toner, a copolymer of at least one of acrylic acid ester and methacrylic acid ester and at least one of acrylic acid and methacrylic acid (an acrylate-based copolymer) is contained as the retention aid. A preferable acid monomer is acrylic acid.

In the present invention, there may be used the following: a copolymer of acrylic acid ester and acrylic acid, a copolymer of acrylic acid ester and methacrylic acid, a copolymer of methacrylic acid ester and acrylic acid, a copolymer of methacrylic acid ester and methacrylic acid, a copolymer of acrylic acid ester, methacrylic acid ester and acrylic acid, a copolymer of acrylic acid ester, methacrylic acid ester and methacrylic acid, and a copolymer of acrylic acid ester, methacrylic acid ester, acrylic acid and methacrylic acid. Of them, the copolymer of acrylic acid ester, methacrylic acid ester and acrylic acid is preferably used in the present invention.

The acid value of the copolymer is generally in the range from 0.5 to 7 mgKOH/g, preferably in the range from 1 to 6 mgKOH/g, more preferably in the range from 1.5 to 4 mgKOH/g. When the acid value of the copolymer is less than 0.5 mgKOH/g, as shown in the below-described Comparative Examples 6 and 7, poor heat-resistant storage stability, poor low-temperature fixability and poor printing durability under a wide range of temperature and humidity environments from a low temperature and low humidity environment to a high temperature and high humidity environment, are obtained. When the acid value of the copolymer exceeds 7 mgKOH/g, as shown in the below-described Comparative Example 8, desired colored resin particles may not be produced.

The acid value of the copolymer is a value measured in conformity to JIS K 0070, which is a standard method for the analysis of fats and oils established by Japanese Industrial Standards Committee (JICS).

The weight average molecular weight (Mw) of the copolymer is generally in a range from 6,000 to 50,000, preferably in a range from 7,000 to 45,000, more preferably in a range from 9,000 to 40,000.

When the weight average molecular weight (Mw) of the copolymer is less than 6,000, the weight average molecular weight is too small, so that heat-resistant storage stability and durability deteriorate. On the other hand, when the weight average molecular weight (Mw) of the copolymer exceeds 50,000, the weight average molecular weight is too large, so that low-temperature fixability deteriorates.

The weight average molecular weight (Mw) of the copolymer can be calculated by using gel permeation chromatography (GPC) on the copolymer or a solution thereof and, based on a GPC elution curve thus obtained, appropriately using the calibration curve for a standard material. An example of the GPC measurement condition is as follows.

Eluent: THF

Flow rate: 0.5 to 3.0 mL/min

Temperature: 25 to 50° C.

The glass transition temperature Tg of the copolymer is generally in a range from 60 to 85° C., preferably in a range from 65 to 80° C., more preferably in a range from 70 to 77° C.

When the glass transition temperature of the copolymer is less than 60° C., the glass transition temperature is too low, so that, as shown in the below-described Comparative Example 4, heat-resistant storage stability is poor. On the other hand, when the glass transition temperature of the copolymer exceeds 85° C., low-temperature fixability deteriorates.

The glass transition temperature Tg of the copolymer can be obtained in conformity to ASTM D3418-82, for example. More specifically, by means of a differential scanning calorimeter (product name: SSC5200; manufactured by: Seiko Instruments, Inc.) or the like, the temperature of the copolymer sample is increased at a heating rate of 10° C./min, and the temperature which shows the maximum thermal peak of a DSC curve obtained in this process, can be used as the glass transition temperature.

The ratio of the acrylic acid ester monomer unit, methacrylic acid ester monomer unit, acrylic acid monomer unit and methacrylic acid monomer unit contained in the copolymer is not particularly limited, as long as it satisfies the above-described acid value, weight average molecular weight Mw and glass transition temperature.

The ratio of the four monomer units can be controlled by the mass ratio of the added amounts of the acrylic acid ester, methacrylic acid ester, acrylic acid and methacrylic acid, which were added at the time of synthesizing the copolymer. The mass ratio of the added amounts can be (acrylic acid ester and/or methacrylic acid ester):(acrylic acid and/or methacrylic acid)=(99 to 99.95):(0.05 to 1), for example. The mass ratio is preferably (acrylic acid ester and/or methacrylic acid ester):(acrylic acid and/or methacrylic acid)=(99.4 to 99.9):(0.1 to 0.6), more preferably (acrylic acid ester and/or methacrylic acid ester):(acrylic acid and/or methacrylic acid)=(99.5 to 99.7):(0.3 to 0.5). Of the monomer units, the acrylic acid ester and/or the methacrylic acid ester can be substituted with other monomer such as the above-exemplified styrene derivative, nitrile compound or amide compound as the monovinyl monomer constituting the binder resin, to the extent that does not deteriorate the effects of the present invention. The ratio is 10% by mass or less of the total added amount of the acrylic acid ester and/or the methacrylic acid ester, preferably 2% by mass or less, and it is preferable that the acrylic acid ester and/or the methacrylic acid ester is not substituted.

Examples of the acrylic acid ester used in the copolymer include methyl acrylate, ethyl acrylate, n-propyl acrylate, isopropyl acrylate, n-butyl acrylate, isobutyl acrylate, sec-butyl acrylate, tert-butyl acrylate, n-pentyl acrylate, sec-pentyl acrylate, isopentyl acrylate, neopentyl acrylate, n-hexyl acrylate, isohexyl acrylate, neohexyl acrylate, sec-hexyl acrylate and tert-hexyl acrylate. Of them, ethyl acrylate, n-propyl acrylate, isopropyl acrylate and n-butyl acrylate are preferred, and n-butyl acrylate is more preferred.

Examples of the methacrylic acid ester used in the copolymer include methyl methacrylate, ethyl methacrylate, n-propyl methacrylate, isopropyl methacrylate, n-butyl methacrylate, isobutyl methacrylate, sec-butyl methacrylate, tert-butyl methacrylate, n-pentyl methacrylate, sec-pentyl methacrylate, isopentyl methacrylate, neopentyl methacrylate, n-hexyl methacrylate, isohexyl methacrylate, neohexyl methacrylate, sec-hexyl methacrylate and tert-hexyl methacrylate. Of them, methyl methacrylate, n-propyl methacrylate, isopropyl methacrylate and n-butyl methacrylate are preferred, and methyl methacrylate is more preferred.

The added amount of the copolymer is preferably in a range from 0.5 to 4 parts by mass, with respect to 100 parts by mass of the binder resin.

When the added amount of the copolymer is less than 0.5 part by mass, the added amount of the copolymer is too small, so that the above-described effects of the present invention, i.e., an excellent balance between heat-resistant storage stability and low-temperature fixability and excellent printing durability under a wide range of temperature and humidity environments, may not be fully obtained. When the added amount of the copolymer exceeds 4 parts by mass, low-temperature fixability may lower.

The added amount of the copolymer is preferably in a range from 1.0 to 3.5 parts by mass, more preferably in a range from 1.5 to 3.0 parts by mass, with respect to 100 parts by mass of the binder resin.

As the copolymer, which is the retention aid used in the present invention, commercially-available products can be used. Also, the copolymer can be produced by known methods such as a solution polymerization method, an aqueous solution polymerization method, an ionic polymerization method, a high temperature and high humidity polymerization method and a suspension polymerization method.

A typical example of the method for producing the copolymer is as follows. The copolymer production method used in the present invention is not limited to the following typical example.

First, a solvent is appropriately put in a reaction container. The atmosphere inside the reaction container is replaced by an inert atmosphere, followed by heating, and then acrylic acid ester and/or methacrylic acid ester and acrylic acid and/or methacrylic acid, which are all raw material monomers, are put in the reaction container. At this time, it is preferable to add a polymerization initiator together. It is also preferable to gradually add a mixture of the raw material monomer and the polymerization initiator in the reaction container, in a dropwise manner.

Next, the temperature was increased to a temperature at which a polymerization reaction is developed, thereby initiating polymerization. After the polymerization is completed, the solvent is appropriately removed, thereby obtaining the desired copolymer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, these colorants can be used alone or in combination of two or more kinds. The amount of the colorant is preferably in the range from 1 to 10 parts by mass, with respect to 100 parts by mass of the monovinyl monomer.

The colored resin particles used in the present invention preferably contain, as the softening agent, a monoester compound which has a structure represented by the following formula (1) and a melting point of 60 to 75° C.:

$$R^1—COO—R^2 \qquad \text{Formula (1)}$$

wherein $R^1$ is a straight-chain alkyl group having 15 to 21 carbon atoms, and $R^2$ is a straight-chain alkyl group having 16 to 22 carbon atoms. $R^1$ and $R^2$ can be groups which are the same as or different from each other. In the monoester compound represented by the formula (1), the difference between the carbon number of the raw material fatty acid (i.e., the carbon number obtained by adding 1 to the carbon number of $R^1$) and the carbon number of the raw material alcohol (i.e., the carbon number of $R^2$) is preferably 0 to 6, more preferably 4 to 6.

When the melting point of the monoester compound is less than 60° C., the toner may be poor in heat-resistant storage stability. When the melting point of the monoester compound exceeds 75° C., low-temperature fixability may lower.

The melting point of the monoester compound is more preferably in a range from 63 to 72° C., more preferably in a range from 65 to 70° C.

Concrete examples of the monoester compound represented by the formula (1) include behenyl palmitate ($C_{15}H_{31}$—COO—$C_{22}H_{45}$), behenyl stearate ($C_{17}H_{35}$—COO—$C_{22}H_{45}$), behenyl eicosanoate ($C_{19}H_{39}$—COO—$C_{22}H_{45}$), behenyl behenate ($C_{21}H_{43}$—COO—$C_{22}H_{45}$), eicosyl palmitate ($C_{15}H_{39}$—COO—$C_{20}H_{41}$), eicosyl stearate ($C_{17}H_{35}$—COO—$C_{20}H_{41}$), eicosyl eicosanoate ($C_{19}H_{39}$—COO—$C_{20}H_{41}$), eicosyl behenate ($C_{21}H_{43}$—COO—$C_{20}H_{41}$), stearyl stearate ($C_{17}H_{35}$—COO—$C_{18}H_{37}$), stearyl eicosanoate ($C_{19}H_{39}$—COO—$C_{18}H_{37}$), stearyl behenate ($C_{21}H_{43}$—COO—$C_{18}H_{37}$), hexadecyl eicosanoate ($C_{19}H_{39}$—COO—$C_{16}H_{33}$) and hexadecyl behenate ($C_{21}H_{43}$—COO—$C_{16}H_{33}$). Of these monoester compounds, behenyl stearate, behenyl palmitate and stearyl behenate are more preferred.

The content of the softening agent is preferably in a range from 10 to 25 parts by mass, with respect to 100 parts by mass of the colored resin particles. In the case of using two or more kinds of softening agents, the total content of all softening agents is preferably in a range from 10 to 25 parts by mass, with respect to 100 parts by mass of the colored resin particles. When the content of the softening agent is less than 10 parts by mass, the content is too small and may result in a deterioration in low-temperature fixability. When the content of the softening agent exceeds 25 parts by mass, the content is too large and may result in a deterioration in heat-resistant storage stability and durability.

The content of the softening agent is more preferably in a range from 12 to 22 parts by mass, even more preferably in a range from 15 to 20 parts by mass, with respect to 100 parts by mass of the colored resin particles.

Other ester compound can be contained as the softening agent. Concrete examples thereof include pentaerythritol ester compounds such as pentaerythritol tetrabehenate, pentaerythritol tetrapalminate and pentaerythtol tetrastearate, and glycerin ester compounds such as hexaglycerin octabehenate, pentaglycerin heptabehenate, tetraglycerin hexabehenate, triglycerin pentabehenate, diglycerin tetrabehenate and glycerin tribehenate.

The acid value of the monoester compound is preferably 1.0 mgKOH/g or less, more preferably 0.6 mgKOH/g or less, even more preferably 0.3 mgKOH/g or less. When the acid value is larger than 1.0 mgKOH/g, shelf stability may deteriorate. The acid value of the monoester compound is a value measured in conformity to JIS K 0070, which is a standard method for the analysis of fats and oils established by Japanese Industrial Standards Committee (JICS).

The hydroxyl value of the monoester compound is preferably 10 mgKOH/g or less, more preferably 6 mgKOH/g or less, even more preferably 3 mgKOH/g or less. When the hydroxyl value is larger than 10 mgKOH/g, shelf stability may deteriorate. The hydroxyl value of the monoester compound is a value measured in conformity to JIS K 0070, which is a standard method for the analysis of fats and oils established by Japanese Industrial Standards Committee (JICS).

It is preferable that the monoester compound satisfies both of the above-described acid value and hydroxyl value conditions.

As the method for producing the softening agent, there may be mentioned a method of synthesis by an oxidation reaction, synthesis from carboxylic acid and derivatives thereof, ester group introducing reactions as typified by the Michael addition reaction, a method using a dehydration-condensation reaction from a carboxylic acid compound and an alcohol compound, a reaction from an acid halide and an alcohol compound, and an ester-exchange reaction. In the production of the softening agent, a catalyst can be appropriately used. As the catalyst, a general acidic or alkaline catalyst used in the esterification reaction, such as zinc acetate or a titanium compound, are preferable. After the esterification reaction, the target product can be purified by recrystallization, distillation, etc.

As another additive, to improve the charging ability of the toner, a charge control agent having positively charging ability or negatively charging ability can be used.

The charge control agent is not particularly limited, as long as it is one that is generally used as a charge control agent for toners. Among charge control agents, a charge control resin having positively charging ability or negatively charging ability is preferably used, since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid base-containing copolymers, carboxylic acid group-containing copolymers and carboxylic acid base-containing copolymers, which are preferably used as the charge control resin.

In the present invention, it is desirable that the amount of the charge control agent to be used is generally in the range from 0.01 to 10 parts by mass, preferably from 0.03 to 8 parts by mass, with respect to 100 parts by mass of the monovinyl monomer. When the added amount of the charge control agent is less than 0.01 part by mass, fog may occur. On the other hand, when the added amount of the charge control agent exceeds 10 parts by mass, printing soiling may occur.

As another additive, a molecular weight modifier is preferably used upon the polymerization of the polymerizable monomer which is polymerized into a binder resin.

The molecular weight modifier is not particularly limited, as long as it is one that is generally used as a molecular weight modifier for toners. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition containing at least a polymerizable monomer, a colorant, a softening agent and a retention aid is dispersed in an aqueous medium containing a dispersion stabilizer, and a polymerization initiator is added therein. Then, the droplets of the polymerizable monomer composition are formed. The method for forming the droplets is not particularly limited. For example, the droplets are formed by means of a device capable of strong agitation, such as an (in-line type) emulsifying and dispersing machine (product name: MILDER; manufactured by Pacific Machinery & Engineering Co., Ltd.) and a high-speed emulsifying and dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxy diethylacetate, t-hexylperoxy-2-ethylbutanoate, diisopropylperoxydicarbonate, di-t-butylperoxyisophthalate and t-butylperoxyisobutyrate. They can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e., peroxy esters having no aromatic ring, since they have excellent initiator efficiency and can reduce residual polymerizable monomer.

The polymerization initiator may be added after dispersing the polymerizable monomer composition into the aqueous medium and before forming droplets as described above, or may be added to the polymerizable monomer composition before the polymerizable monomer composition is dispersed into the aqueous medium.

The added amount of the polymerization initiator used for the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloids of inorganic compounds, particularly a colloid of a hardly water-soluble metal hydroxide, is preferable. By using a colloid of an inorganic compound, particularly a colloid of a hardly water-soluble metal hydroxide, the colored resin particles can have a small particle size distribution, and the amount of the dispersion stabilizer remaining after washing can be small, so that the toner thus obtained can clearly reproduce an image and has excellent environmental stability.

(A-3) Polymerization Process

Formation of the droplets is carried out as described under the above (A-2). The thus-obtained aqueous dispersion medium is heated to polymerize, thereby forming an aqueous dispersion of colored resin particles.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particles may be mixed with an external additive and used as a polymerized toner. It is preferable that the colored resin particles are so-called core-shell type (or "capsule type") colored resin particles obtained by using the colored resin particles as a core layer and forming a shell layer, which is a layer that is different from the core layer, around the core layer. The core-shell type colored resin particles can take a balance of lowering of fixing temperature and prevention of blocking at storage, since the core layer including a substance having a low softening point is covered with a substance having a higher softening point.

A method for producing the above-mentioned core-shell type colored resin particles using the colored resin particles is not particularly limited, and the core-shell type colored resin particles can be produced by any conventional method. The in situ polymerization method and the phase separation method are preferable from the viewpoint of production efficiency.

Hereinafter, a method for producing the core-shell type colored resin particles according to the in situ polymerization method will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the mixture.

As the polymerizable monomer for shell, the above-mentioned polymerizable monomers can be used. Among the polymerizable monomers, it is preferable to use monomers which can provide a polymer having a Tg of more than 80° C., such as styrene, acrylonitrile and methyl methacrylate, alone or in combination of two or more kinds.

Examples of the polymerization initiator used for polymerization of the polymerizable monomer for shell include water-soluble polymerization initiators including: metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone or in combination of two or more kinds. The amount of the polymerization initiator is preferably in the range from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that after the polymerization, the aqueous dispersion of the colored resin particles obtained by the polymerization is subjected to operations including filtering, washing for removing the dispersion stabilizer, dehydrating and drying several times as needed, according to any conventional method.

In the washing method, when the inorganic compound is used as the dispersion stabilizer, it is preferable to add acid or alkali to the aqueous dispersion of the colored resin particles, thereby dissolving the dispersion stabilizer in water and removing it. When the colloid of the hardly water-soluble inorganic hydroxide is used as the dispersion stabilizer, it is preferable to control the pH of the aqueous dispersion of the colored resin particles to 6.5 or less by adding acid. Examples of the acid to be added include inorganic acids such as sulfuric acid, hydrochloric acid and nitric acid, and organic acids such as formic acid and acetic acid. Particularly, sulfuric acid is suitable for its high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the colored resin particles are produced by the following processes.

First, a binder resin, a colorant, a softening agent, a retention aid and other additives such as a charge control agent, which are added if required, are mixed by means of a mixer such as a ball mill, a V type mixer, an FM Mixer (product name), a high-speed dissolver, an internal mixer or the like. Next, the thus-obtained mixture is kneaded while heating by means of a press kneader, a twin screw kneading machine, a roller or the like. The obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are used under the above "(A) Suspension polymerization method", that is, the binder resin, the colorant, the softening agent, the retention aid and the additives added if required, such as the charge control agent, can be used. Similarly to the colored resin particles obtained under the above "(A) Suspension polymerization method", the colored resin particles obtained by the pulverization method can be core-shell type colored resin particles by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the production method such as the above-mentioned "(A) Suspension polymerization method" or "(B) Pulverization method".

Hereinafter, the colored resin particles constituting the toner will be described. The below-mentioned colored resin particles encompass both core-shell type colored resin particles and colored resin particles which are not core-shell type.

The volume average particle diameter (Dv) of the colored resin particles is preferably in the range from 4 to 12 μm, more preferably from 5 to 10 μm. When the volume average particle diameter (Dv) of the colored resin particles is less than 4 μm, the flowability of the toner may lower and deteriorate transferability or decrease image density. When the volume average particle diameter (Dv) of the colored resin particles exceeds 12 μm, the resolution of images may decrease.

As for the colored resin particles, the ratio (Dv/Dp) of the volume average particle diameter (Dv) and the number average particle diameter (Dp) is preferably in the range from 1.0 to 1.3, more preferably from 1.0 to 1.2. When the ratio Dv/Dp exceeds 1.3, there may be a decrease in transferability, image density and resolution. The volume average particle diameter and the number average particle diameter of the colored resin particles can be measured by a particle diameter measuring device (product name: Multisizer; manufactured by: Beckman Coulter, Inc.), for example.

The average circularity of the colored resin particles of the present invention is preferably in the range from 0.96 to 1.00, more preferably from 0.97 to 1.00, even more preferably from 0.98 to 1.00, from the viewpoint of image reproducibility.

When the average circularity of the colored resin particles is less than 0.96, thin line reproducibility may deteriorate.

In the present invention, "circularity" is defined as a value which is obtained by dividing the perimeter of a circle having the same area as the projected area of a particle image by the perimeter of the particle image. Also in the present invention, "average circularity" is used as a simple method for quantitatively describing the shape of the particles and is an indicator that shows the degree of the surface roughness of the colored resin particles. The average circularity is 1 when the colored resin particles are perfectly spherical, and it gets smaller as the surface shape of the colored resin particles becomes more complex.

3. Production Method of Toner

In the present invention, the colored resin particles and the external additive are mixed and agitated to cover the colored resin particles with the external additive and attach the external additive to the surface of the colored resin particles, thereby obtaining a one-component toner (developer). The one-component toner can be further mixed with carrier particles and agitated to obtain a two-component developer.

The agitator used to cover the colored resin particles with the external additives is not particularly limited, as long as it is an agitating device that is able to attach the external additives to the surface of the colored resin particles. For example, the colored resin particles can be covered with the external additives by using an agitator that is capable of mixing and agitation, such as FM Mixer (product name; manufactured by: Nippon Coke & Engineering Co., Ltd.), Super Mixer (product name; manufactured by: Kawata Manufacturing Co., Ltd.), Q Mixer (product name; Nippon Coke & Engineering Co., Ltd.), Mechanofusion System (product name; manufactured by: Hosokawa Micron Corporation) and Mechanomill (product name; manufactured by: Okada Seiko Co., Ltd.)

As the external additives, there may be mentioned: inorganic fine particles made of silica, titanium oxide, aluminum oxide, zinc oxide, tin oxide, calcium carbonate, calcium phosphate and/or cerium oxide, for example; and organic fine particles made of polymethyl methacrylate resin, silicone resin and/or melamine resin, for example. Of them, the inorganic fine particles are preferred. Of the inorganic fine particles, silica and/or titanium oxide is preferred, and fine particles made of silica are particularly preferred.

These external additives can be used alone or in combination of two or more kinds. It is particularly preferable to use two or more kinds of silica having different particle diameters.

In the present invention, it is desirable that the external additive is used in an amount of generally 0.05 to 6 parts by mass, preferably 0.2 to 5 parts by mass, with respect to 100 parts by mass of the colored resin particles. When the added amount of the external additive is less than 0.05 part by mass, toner transferability may lower. When the added amount of the external additive exceeds 6 parts by mass, fog may occur.

4. Toner of the Present Invention

The toner of the present invention obtained through the above process is a toner which has an excellent balance between heat-resistant storage stability and low-temperature fixability and which is able to exhibit excellent printing durability under all of a high temperature and high humidity (H/H) environment, a normal temperature and normal humidity (N/N) environment, and a low temperature and low humidity (L/L) environment.

As an indicator of heat-resistant storage stability, for example, there may be mentioned a heatproof temperature determined by the following method.

After a predetermined amount of toner is put in a container, the container is hermetically sealed. The container is left in a predetermined temperature condition. After the elapse of a predetermined period of time, the toner is removed from the container onto a screen and set in a powder measuring device (product name: Powder Tester PT-R; manufactured by: Hosokawa Micron Corporation) or the like. After the screen is vibrated in a predetermined amplitude condition for a predetermined period of time, the mass of the toner remaining on the screen is measured and used as the mass of the aggregated toner. The maximum temperature at which the mass of the aggregated toner is equal to or less than a predetermined threshold value, is determined as the heatproof temperature of the toner.

As an indicator of low-temperature fixability, for example, there may be mentioned a minimum fixing temperature determined by the following method.

The fixing rate of the toner at a predetermined temperature is measured with a predetermined printer. The toner fixing rate is calculated from the ratio of image densities of a black solid area, which is an area printed on a test sheet by the printer, before and after subjected to a predetermined tape removal operation. More specifically, when the image density before the tape removal is referred to as "ID (before)" and the image density after the tape removal is referred to as "ID (after)", the toner fixing rate can be calculated by the following formula. Image density is measured with a spectrophotometer (product name: SpectroEye; manufactured by: X-Rite Inc.) or the like.

$$\text{Fixing rate (\%)}=(\text{ID(after)}/\text{ID(before)})\times 100$$

In this fixing test, the temperature at which the toner fixing rate is equal to or more than a predetermined threshold value, is determined as the minimum fixing temperature of the toner.

The heatproof temperature is preferably 55° C. or more. When the heatproof temperature is less than 55° C., blocking is likely to occur when subjected to high heat, and quality may not be assured after transportation. Even if the toner is high in heatproof temperature and excellent in heat-resistant storage stability, a lot of energy is required to fix the toner in image forming devices when the minimum fixing temperature of the toner is too high, so that it is not preferable from an environmental point of view.

EXAMPLES

Hereinafter, the present invention will be described further in detail, with reference to examples and comparative examples. However, the scope of the present invention may not be limited to the following examples. Herein, "part(s)" and "%" are based on mass if not particularly mentioned.

Test methods used in the examples and the comparative examples are as follows.

1. Synthesis of Copolymer

Production Example 1

First, 200 parts of toluene was put in a reaction container. With agitating the toluene, the atmosphere inside the reaction container was sufficiently replaced by nitrogen, and then the temperature was increased to 90° C. Then, a mixed solution of 97 parts of methyl methacrylate, 2.6 parts of n-butyl acrylate, 0.4 part of acrylic acid and 3 parts of t-butylperoxy-2-ethylhexanoate (product name: Perbutyl 0; manufactured by: NOF Corporation) was put in the reaction container for two hours in a dropwise manner. In addition, the mixture was maintained for 10 hours while refluxing the toluene, thereby completing polymerization. Then, the solvent was removed by distillation under reduced pressure. The thus-obtained copolymer is referred to as copolymer 1. The properties of the thus-obtained copolymer 1 are shown in Table 1.

Production Examples 2 to 15

Copolymers 2 to 15 were synthesized in the same manner as Production Example 1, except that the composition ratio of the monomers and the amount of the initiator were changed as shown in Table 1. The properties of the thus-obtained copolymers 2 to 15 are shown in Table 1.

2. Properties of Raw Materials for Toner (1) Glass Transition Temperature (Tg) of Copolymer In conformity to ASTM D3418-82, the temperatures which show the maximum endothermic peaks of the copolymers 1 to 15 (the maximum endothermic peak temperatures) were measured. More specifically, by means of a differential scanning calorimeter (product name: SSC5200; manufactured by: Seiko Instruments, Inc.), the temperature of each copolymer sample was increased at a heating rate of 10° C./min, and the temperature which shows the maximum endothermic peak of a DSC curve obtained in this process was measured and used as the glass transition temperature (Tg) of the copolymer.

(2) Acid Value of Copolymer and Acid Value and Hydroxyl Value of Softening Agent (Monoester Compound)

The acid values of the copolymers 1 to 15 and the acid value of the monoester compound used as the softening agent were measured in conformity to JIS K 0070, which is a standard method for the analysis of fats and oils established by Japanese Industrial Standards Committee (JICS).

The hydroxyl value of the monoester compound used as the softening agent was measured in conformity to JIS K 0070, which is a standard method for the analysis of fats and oils established by Japanese Industrial Standards Committee (JICS).

(3) Weight Average Molecular Weight (Mw) of Copolymer

First, 0.1 g of each copolymer sample was weighed and put in a 100 mL glass sample bottle. Then, 49.9 g of THF was added thereto. Next, a stirrer chip was put in the bottle, and the mixture was agitated for one hour at room temperature using a magnetic stirrer. Then, the mixture was filtered with a 0.2 μm PTFE filter to obtain a THF solution of the copolymer. Finally, 100 μL of each THF solution was injected into a GPC measurement device and measured by GPC. Based on the thus-obtained GPC elution curve, the weight average molecular weight (Mw) was calculated with the calibration curve of a commercially-available monodisperse standard polystyrene.

(GPC Measurement Conditions)

GPC: HLC-8220 (manufactured by Tosoh Corporation)

Column: Two TSK-GEL MULTIPORE HXL-M columns directly connected to each other (manufactured by Tosoh Corporation)

Eluent: THF

Flow rate: 1.0 mL/min

Temperature: 40° C.

The measurement results of the copolymers 1 to 15 are shown in Table 1, along with the compositions of the copolymers. In Table 1, "AA" means the added amount of acrylic acid; "MAA" means the added amount of methacrylic acid; "MMA" means the added amount of methyl methacrylate; "EA" means the added amount of ethyl acrylate; "BA" means the added amount of n-butyl acrylate; "ST" means the added amount of styrene; and "initiator" means the added amount of t-butylperoxy-2-ethylhexanoate.

TABLE 1

| | Copolymer 1 | Copolymer 2 | Copolymer 3 | Copolymer 4 | Copolymer 5 | Copolymer 6 | Copolymer 7 | Copolymer 8 |
|---|---|---|---|---|---|---|---|---|
| AA | 0.4 | 0.4 | 0.2 | 0.4 | 0.4 | 0.4 | — | 0.9 |
| MAA | — | — | — | — | — | — | 0.4 | — |
| MMA | 97 | 92.8 | 97.2 | 98.7 | 83.7 | 96.2 | 96.2 | 96.7 |
| EA | — | — | — | — | — | 3.5 | — | — |
| BA | 2.6 | 6.8 | 2.6 | 0.9 | 15.9 | — | 2.6 | 2.4 |
| ST | — | — | — | — | — | — | — | — |
| Initiator | 3.0 | 3.0 | 3.0 | 3.8 | 1.0 | 3.0 | 3.0 | 3.0 |
| Tg (° C.) | 75.2 | 65.5 | 75.3 | 74.2 | 75.0 | 74.6 | 76.0 | 75.8 |
| Acid value (mgKOH/g) | 2.6 | 2.5 | 0.8 | 2.3 | 2.4 | 2.4 | 2.4 | 5.9 |
| Mw | 9500 | 11000 | 9800 | 7500 | 35000 | 10000 | 9400 | 9600 |

| | Copolymer 9 | Copolymer 10 | Copolymer 11 | Copolymer 12 | Copolymer 13 | Copolymer 14 | Copolymer 15 |
|---|---|---|---|---|---|---|---|
| AA | 0.4 | 0.4 | 0.4 | 0.4 | — | — | 1.5 |
| MAA | — | — | — | — | — | — | — |
| MMA | — | 50.7 | 84.0 | 98.0 | 20 | 97.3 | 95.8 |
| EA | — | — | — | — | — | — | — |
| BA | — | — | 15.6 | 2.6 | 80 | 2.7 | 2.7 |
| ST | 99.6 | 48.9 | — | — | — | — | — |
| Initiator | 3.0 | 3.0 | 3.0 | 1.0 | 4.5 | 3.0 | 3.0 |
| Tg (° C.) | 76.2 | 77 | 55 | 95 | −70 | 76.3 | 75.5 |
| Acid value (mgKOH/g) | 2.5 | 2.3 | 2.3 | 2.4 | 0 | 0 | 9.0 |
| Mw | 9400 | 10300 | 9800 | 40100 | 6000 | 10200 | 9900 |

3. Production of Toner for Developing Electrostatic Images

Example 1

First, 70 parts of styrene and 30 parts of n-butyl acrylate as monovinyl monomers, 7 parts of carbon black (product name: #25B; manufactured by: Mitsubishi Chemical Corporation) as a black colorant, 0.7 part of divinylbenzene as a crosslinkable polymerizable monomer, 1.0 part of t-dodecyl mercaptan as a molecular weight modifier, and 2 parts of the copolymer 1 obtained in the above Production Example 1, were subjected to wet pulverization using a media type wet pulverizer. Then, the resultant was further mixed with 1 part of a positively-chargeable charge control resin (a quaternary ammonium group-containing styrene/acrylic copolymer) as a charge control agent and 20 parts of behenyl stearate (molecular formula: $C_{17}H_{35}$—COO—$C_{22}H_{45}$, melting point: 70° C., acid value: 0.1 mgKOH/g, hydroxyl value: 0.3 mgKOH/g) as a softening agent, thereby obtaining a polymerizable monomer composition.

Separately, in an agitation tank, an aqueous solution of 4.1 parts of sodium hydroxide dissolved in 50 parts of ion-exchanged water was gradually added to an aqueous solution of 7.4 parts of magnesium chloride dissolved in 250 parts of ion-exchanged water, while agitating at room temperature, to prepare a magnesium hydroxide colloid dispersion (magnesium hydroxide 3.0 parts).

The polymerizable monomer composition was put in the above-obtained magnesium hydroxide colloid dispersion and agitated at room temperature until the droplets became stable. After 5 parts of t-butylperoxy-2-ethylhexanoate (product name: PERBUTYL 0; manufactured by: NOF Corporation) was added therein as a polymerization initiator, the resultant mixture was subjected to high shear agitation at 15,000 rpm using an in-line type emulsifying and dispersing machine (product name: MILDER; manufactured by: Pacific Machinery & Engineering Co., Ltd.), thereby forming the droplets of the polymerizable monomer composition.

The suspension having the above-obtained droplets of the polymerizable monomer composition dispersed therein (a polymerizable monomer composition dispersion) was charged into a reactor furnished with an agitating blade, and the temperature thereof was raised to 90° C. to start a polymerization reaction. When the polymerization conversion rate reached almost 100%, 1.5 parts of methyl methacrylate (a polymerizable monomer for shell) and 0.10 part of 2,2'-azobis(2-methyl-N-(2-hydroxyethyl)-propionamide) (a water-soluble polymerization initiator for shell; product name: VA-086; manufactured by: Wako Pure Chemical Industries, Ltd.) dissolved in 20 parts of ion-exchanged water were put in the reactor. After maintaining and continuing the polymerization for another 3 hours at 90° C., the reactor was cooled by water to stop the reaction, thereby obtaining an aqueous dispersion of colored resin particles.

The above-obtained aqueous dispersion of colored resin particles was subjected to acid washing in which, while agitating at room temperature, sulfuric acid was added dropwise until the pH of the aqueous dispersion was 6.5 or less. Then, the aqueous dispersion was subjected to filtration separation, and the thus-obtained solid was re-slurried with 500 parts of ion-exchanged water, and a water washing treatment (washing, filtration and dehydration) was carried out thereon several times. Next, filtration separation was carried out thereon, and the thus-obtained solid was placed in the container of a dryer and dried at 45° C. for 48 hours, thereby obtaining dried colored resin particles.

To 100 parts of the colored resin particles, 0.7 part of silica fine particles A having a number average primary particle diameter of 10 nm and 1 part of silica fine particles B having a number average primary particle diameter of 55 nm and being hydrophobized with amino-modified silicone oil, were added and mixed by means of a high-speed agitator (product name: FM Mixer; manufactured by: Nippon Coke & Engineering Co., Ltd.) to cover the colored resin particles with the silica fine particles, thereby producing the toner for developing electrostatic images of Example 1.

Examples 2 to 10

The toners for developing electrostatic images of Example 2 to 8 were produced in the same manner as Example 1, except that 2 parts of each of the copolymers 2 to 8 obtained in Production Examples 2 to 8 was added in place of adding 2 part of the copolymer 1 obtained in Production Example 1. Also, the toners for developing electrostatic images of Example 9 and 10 were produced in the same manner as Example 1, except that the added amount of the copolymer 1 obtained in Production Example 1 was changed from 2 parts to 1 or 3 parts.

Comparative Example 1

The toner for developing electrostatic images of Comparative Example 1 was produced in the same manner as Example 1, except that the copolymer 1 obtained in Production Example 1 was not added.

Comparative Examples 2 to 8

The toners for developing electrostatic images of Comparative Examples 2 to 8 were produced in the same manner as Example 1, except that 2 parts of each of the copolymers 9 to 15 obtained in Production Examples 9 to 15 was added in place of adding 2 parts of the copolymer 1 obtained in Production Example 1. However, polymerization was not carried out in Comparative Example 8, since droplets were not successfully formed. Accordingly, the subsequent evaluation was not carried out.

4. Evaluation of Properties of Colored Resin Particles and Toners

The properties of the toners of Examples 1 to 10 and Comparative Examples 1 to 7 were examined. Also, the properties of the colored resin particles used in the toners were examined. Details are as follows.

(1) Particle Size Properties of Colored Resin Particles

The volume average particle diameter Dv, the number average particle diameter Dp and the particle size distribution Dv/Dp of the colored resin particles were measured with a particle diameter measuring device (product name: Multisizer; manufactured by: Beckman Coulter, Inc.) This measurement was carried out by the Multisizer in the following conditions:

Aperture diameter: 100 μm

Dispersion medium: Isoton II (product name)

Concentration: 10%

Number of measured particles: 100,000 particles

More specifically, 0.2 g of the colored resin particle sample was put in a beaker. An alkylbenzene sulfonic acid aqueous solution (product name: Driwel; manufactured by: Fujifilm Corporation) was added thereto, which serves as a dispersant. In addition, 2 mL of the dispersion medium was added to wet the colored resin particles. Then, 10 mL of the dispersion medium was added thereto, and the mixture was dispersed for one minute with an ultrasonic disperser and then measured by the above-mentioned particle diameter measuring device.

(2) Heat-Resistant Storage Stability of Toner

After 10 g of each toner was put in a 100 mL polyethylene container, the container was hermetically sealed. Then, the container was immersed in a constant temperature water bath at a predetermined temperature for 8 hours, and then removed from the bath. The toner was removed from the container onto a 42-mesh screen, keeping the toner away from vibration as much as possible, and then set in a powder measuring device (product name: Powder Tester PT-R; manufactured by Hosokawa Micron Corporation). The screen was vibrated at an amplitude of 1.0 mm for 30 seconds. The mass of the toner remaining on the screen was measured and used as the mass of the aggregated toner.

The maximum temperature at which the mass of the aggregated toner is 0.5 g or less, was used as the heatproof temperature.

(3) Printing Evaluation of Toner (a) Measurement of Fixing Temperature of Toner

A fixing test was carried out by using a commercially-available, non-magnetic one-component development printer (resolution 600 dpi, printing rate 28 sheets/min) which had been modified to be able to change the temperature of the fixing roller. In the fixing test, the temperature of the fixing roller of the modified printer was changed, and every time the temperature was changed, the toner fixing rate at each temperature was measured.

The toner fixing rate was calculated from the ratio of image densities of a black solid area, which was printed on a test sheet by the modified printer, before and after subjected to a tape removal operation. More specifically, when the image density before the tape removal is referred to as "ID (before)" and the image density after the tape removal is referred to as "ID (after)", the toner fixing rate can be calculated by the following formula:

$$\text{Fixing rate (\%)}=(\text{ID(after)}/\text{ID(before)})\times 100$$

In particular, the tape removal is an operation having the steps of: attaching a piece of an adhesive tape (product name: Scotch Mending Tape 810-3-18; manufactured by: Sumitomo 3M Limited) to the measurement part (the black solid area) on the test sheet; firmly attaching the tape piece by pressing the piece at a given pressure; and then removing the tape piece at a constant speed in a direction along the sheet. Image density was measured with a spectrophotometer (product name: SpectroEye; manufactured by: X-Rite Inc.) In this fixing test, the minimum fixing roller temperature at which the toner fixing rate is 80% or more, was referred to as the minimum fixing temperature of the toner.

(b) Printing Durability Test Under Different Environments

Printing sheets were set in the printer, and the toner was charged into the printer. The printer was left for 24 hours under a low temperature and low humidity (L/L) environment (temperature: 20° C., humidity: 20% RH). Then, under the same environment, 20,000 sheets were continuously printed at an image density of 5%. Solid pattern printing (image density 100%) was carried out every 500 sheets, and the resulting solid images were measured for image density, by means of a reflection image densitometer (product name: RD918; manufactured by: Macbeth). Then, in addition, another solid pattern printing (image density 0%) was carried out. When printing halfway, the printer was stopped. A piece of an adhesive tape (product name: Scotch Mending Tape 810-3-18; manufactured by: Sumitomo 3M Limited) was attached to the toner in a non-image area present on the photoconductor after development. Then, the tape piece was attached to a printing sheet. Next, the whiteness degree (B) of the printing sheet on which the tape piece was attached, was measured with a whiteness colorimeter (manufactured by: Nippon Denshoku Industries Co., Ltd.) In the same manner, an unused piece of the adhesive tape was attached to the printing sheet, and the whiteness degree (A) was measured. The difference between the whiteness degrees (B-A) was used as the fog value. As the fog value gets smaller, fog preferably decreases.

The number of continuously printed sheets that could maintain such an image quality that the image density is 1.3 or more and the fog value is 5 or less, was measured.

The same test was carried out under a normal temperature and normal humidity (N/N) environment (temperature 23°

C., humidity 50% RH) and a high temperature and high humidity (H/H) environment (temperature 32.5° C., humidity 80% RH).

(c) Printing Durability Test Under Normal Humidity and Normal Temperature (N/N) Environment after being Left at High Temperature Printing sheets were set in the printer, and the toner was charged into the printer. The printer was left for 120 hours under an environment at a temperature of 50° C. Then, the same test as the above-mentioned printing durability test was carried out under a normal temperature and normal humidity (N/N) environment (temperature 23° C., humidity 50% RH).

The measurement and evaluation results of the toners for developing electrostatic images of Examples 1 to 10 and Comparative Examples 1 to 7 are shown in Table 2. In Table 2, "LL durability (sheets)", "NN durability (sheets)" and "HH durability (sheets)" indicate the number of continuously printed sheets in the printing durability test under the low temperature and low humidity (L/L) environment, the number of continuously printed sheets in the printing durability test under the normal temperature and normal humidity (N/N) environment, and the number of continuously printed sheets in the printing durability test under the high temperature and high humidity (H/H) environment, respectively. Also, "NN durability after being left at high temperature (sheets)" indicates the number of continuously printed sheets in the printing durability test under the normal humidity and normal temperature (N/N) environment after being left at the high temperature.

TABLE 2

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Copolymer | Type | Copolymer 1 | Copolymer 2 | Copolymer 3 | Copolymer 4 | Copolymer 5 | Copolymer 6 | Copolymer 7 | Copolymer 8 | Copolymer 1 | Copolymer 1 |
| | Added amount (parts) | 2 | 2 | 2 | 2 | 2 | 2 | 2 | 2 | 1 | 3 |
| Particle size properties of colored resin particles | Volume average particle diameter Dv (μm) | 7.7 | 7.8 | 7.8 | 7.8 | 7.9 | 7.8 | 7.8 | 7.8 | 7.8 | 7.9 |
| | Particle size distribution Dv/Dp | 1.11 | 1.11 | 1.12 | 1.12 | 1.12 | 1.11 | 1.11 | 1.14 | 1.13 | 1.14 |
| Heat resistant storage stability of toner | Heatproof temperature (° C.) | 59 | 58 | 58 | 58 | 60 | 59 | 59 | 60 | 57 | 61 |
| Printing evaluation of toner | Minimum fixing temperature (° C.) | 125 | 120 | 120 | 120 | 125 | 125 | 125 | 130 | 120 | 130 |
| | LL durability (sheets) | 20000< | 19000 | 19000 | 19000 | 20000< | 20000< | 19000 | 18000 | 19000 | 20000< |
| | NN durability (sheets) | 20000< | 19000 | 18000 | 19000 | 20000< | 20000< | 19000 | 19000 | 19000 | 20000< |
| | HH durability (sheets) | 19000 | 18000 | 18000 | 18000 | 20000< | 19000 | 18000 | 18000 | 18000 | 18000 |
| | NN durability after being left at high temperature (sheets) | 19000 | 19000 | 18000 | 19000 | 20000< | 19000 | 18000 | 18000 | 18000 | 20000< |

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Copolymer | Type | — | Copolymer 9 | Copolymer 10 | Copolymer 11 | Copolymer 12 | Copolymer 13 | Copolymer 14 | Copolymer 15 |
| | Added amount (parts) | — | 2 | 2 | 2 | 2 | 2 | 2 | 2 |
| Particle size properties of colored resin particles | Volume average particle diameter Dv (μm) | 8.0 | 7.9 | 7.9 | 7.7 | 7.7 | 7.7 | 7.9 | Polymerization was not carried out since droplets were not successfully formed. |
| | Particle size distribution Dv/Dp | 1.12 | 1.12 | 1.12 | 1.11 | 1.11 | 1.12 | 1.12 | |
| Heat resistant storage stability of toner | Heatproof temperature (° C.) | 53 | 51 | 53 | 53 | 60 | 50 | 54 | |

TABLE 2-continued

| | | | | | | | | |
|---|---|---|---|---|---|---|---|---|
| Printing evaluation of toner | Minimum fixing temperature (° C.) | 115 | 125 | 125 | 115 | 135 | 130 | 130 |
| | LL durability (sheets) | 10000 | 10000 | 11000 | 18000 | 18000 | 15000 | 10000 |
| | NN durability (sheets) | 15000 | 14000 | 16000 | 17000 | 18000 | 16000 | 17000 |
| | HH durability (sheets) | 8000 | 7000 | 10000 | 17000 | 17000 | 15000 | 8000 |
| | NN durability after being left at high temperature (sheets) | 11000 | 11000 | 12000 | 17000 | 18000 | 15000 | 12000 |

5. Evaluation of Toners

Hereinafter, the evaluation results of the toners will be discussed, with reference to Tables 1 and 2.

First, the toner of Comparative Example 1 will be discussed. According to Tables 1 and 2, the toner of Comparative Example 1 contains no polymer as the retention aid.

According to Table 2, the minimum fixing temperature of the toner of Comparative Example 1 is 115° C. Therefore, the toner of Comparative Example 1 has no problem with at least low-temperature fixability.

However, as for the toner of Comparative Example 1, the heatproof temperature is as low as 53° C., and the numbers of continuously printed sheets in the printing durability test are as low as 10,000 under the low temperature and low humidity (L/L) environment, 15,000 under the normal temperature and normal humidity (N/N) environment, 8,000 under the high temperature and high humidity (H/H) environment, and 11,000 under the normal temperature and normal humidity (N/N) environment after being left at the high temperature. Especially, the number of continuously printed sheets under the normal temperature and normal humidity (N/N) environment after being left at the high temperature is the smallest among the toners of Examples 1 to 10 and Comparative Examples 1 to 7.

From the above results, it is clear that the toner of Comparative Example 1 that contains no copolymer as the retention aid, is poor in heat-resistant storage stability and poor in printing durability under the temperature and humidity environments from the low temperature and low humidity environment to the high temperature and high humidity environment.

Next, the toner of Comparative Example 2 will be discussed. According to Tables 1 and 2, the toner of Comparative Example 2 contains the copolymer 9 composed of acrylic acid and styrene. According to Table 1, the copolymer 9 has a glass transition temperature (Tg) of 76.2° C., an acid value of 2.5 mgKOH/g, and a weight average molecular weight (Mw) of 9,400.

According to Table 2, the minimum fixing temperature of the toner of Comparative Example 2 is 125° C. Therefore, the toner of Comparative Example 2 has no problem with at least low-temperature fixability.

However, as for the toner of Comparative Example 2, the heatproof temperature is as low as 51° C., and the numbers of continuously printed sheets in the printing durability test are as low as 10,000 under the low temperature and low humidity (L/L) environment, 14,000 under the normal temperature and normal humidity (N/N) environment, 7,000 under the high temperature and high humidity (H/H) environment, and 11,000 under the normal temperature and normal humidity (N/N) environment after being left at the high temperature. Especially, the number of continuously printed sheets under the high temperature and high humidity (H/H) environment and the number of continuously printed sheets under the normal temperature and normal humidity (N/N) environment after being left at the high temperature, are the smallest among the toners of Examples 1 to 10 and Comparative Examples 1 to 7.

From the above results, it is clear that the toner of Comparative Example 2 which contains neither the acrylic acid ester monomer unit nor the methacrylic acid ester monomer unit and, instead, which uses the copolymer 9 containing the styrene monomer unit, is poor in heat-resistant storage stability, poor in printing durability under the temperature and humidity environments from the low temperature and low humidity environment to the high temperature and high humidity environment, and especially poor in printing durability under the high temperature and high humidity environment.

Next, the toner of Comparative Example 3 will be discussed. According to Tables 1 and 2, the toner of Comparative Example 3 contains the copolymer 10 composed of acrylic acid, methyl methacrylate and styrene. According to Table 1, the copolymer 10 has a glass transition temperature (Tg) of 77° C., an acid value of 2.3 mgKOH/g, and a weight average molecular weight (Mw) of 10,300.

According to Table 2, the minimum fixing temperature of the toner of Comparative Example 3 is 125° C. Therefore, the toner of Comparative Example 3 has no problem with at least low-temperature fixability.

However, as for the toner of Comparative Example 3, the heatproof temperature is as low as 53° C., and the numbers of continuously printed sheets in the printing durability test are as low as 11,000 under the low temperature and low humidity (L/L) environment, 16,000 under the normal temperature and normal humidity (N/N) environment, 10,000 under the high temperature and high humidity (H/H) environment, and 12,000 under the normal temperature and normal humidity (N/N) environment after being left at the high temperature.

From the above results, it is clear that the toner of Comparative Example 3 which uses the copolymer 10 containing the styrene monomer unit, is poor in heat-resistant storage stability and poor in printing durability under the temperature and humidity environments from the low temperature and low humidity environment to the high temperature and high humidity environment.

Next, the toner of Comparative Example 4 will be discussed. According to Tables 1 and 2, the toner of Comparative Example 4 contains the copolymer 11 composed of acrylic acid, methyl methacrylate and n-butyl acrylate. According to Table 1, the copolymer 11 has a glass transition temperature (Tg) of 55° C., an acid value of 2.3 mgKOH/g, and a weight average molecular weight (Mw) of 9,800.

According to Table 2, as for the toner of Comparative Example 4, the minimum fixing temperature is 115° C., and the numbers of continuously printed sheets in the printing durability test are 18,000 under the low temperature and low humidity (L/L) environment, 17,000 under the normal temperature and normal humidity (N/N) environment, 17,000 under the high temperature and high humidity (H/H) environment, and 17,000 under the normal temperature and normal humidity (N/N) environment after being left at the high temperature. Therefore, the toner of Comparative Example 4 has no problem with at least low-temperature fixability and printing durability.

However, the heatproof temperature of the toner of Comparative Example 4 is as low as 53° C.

From the above results, it is clear that the toner of Comparative Example 4 which uses the copolymer 11 having a glass transition temperature of less than 60° C., is poor in heat-resistant storage stability.

Next, the toner of Comparative Example 5 will be discussed. According to Tables 1 and 2, the toner of Comparative Example 5 contains the copolymer 12 composed of acrylic acid, methyl methacrylate and n-butyl acrylate.

According to Table 1, the copolymer 12 has a glass transition temperature (Tg) of 95° C., an acid value of 2.4 mgKOH/g, and a weight average molecular weight (Mw) of 40,100.

According to Table 2, as for the toner of Comparative Example 5, the heatproof temperature is 60° C., and the numbers of continuously printed sheets in the printing durability test are 18,000 under the low temperature and low humidity (L/L) environment, 18,000 under the normal temperature and normal humidity (N/N) environment, 17,000 under the high temperature and high humidity (H/H) environment, and 18,000 under the normal temperature and normal humidity (N/N) environment after being left at the high temperature. Therefore, the toner of Comparative Example 5 has no problem with at least heat-resistant storage stability and printing durability.

However, the minimum fixing temperature of the toner of Comparative Example 5 is as high as 135° C. The minimum fixing temperature of Comparative Example 5 is the highest among the toners of Examples 1 to 10 and Comparative Examples 1 to 7.

From the above results, it is clear that the toner of Comparative Example 5 which uses the copolymer 12 having a glass transition temperature of more than 85° C. is poor in low-temperature fixability.

Next, the toner of Comparative Example 6 will be discussed. According to Tables 1 and 2, the toner of Comparative Example 6 contains the copolymer 13 composed of methyl methacrylate and n-butyl acrylate. According to Table 1, the copolymer 13 has a glass transition temperature (Tg) of −70° C., an acid value of 0 mgKOH/g, and a weight average molecular weight (Mw) of 6,000.

According to Table 2, as for the toner of Comparative Example 6, the heatproof temperature is as low as 50° C., and the numbers of continuously printed sheets in the printing durability test are as low as 15,000 under the low temperature and low humidity (L/L) environment, 16,000 under the normal temperature and normal humidity (N/N) environment, 15,000 under the high temperature and high humidity (H/H) environment, and 15,000 under the normal temperature and normal humidity (N/N) environment after being left at the high temperature. Especially, the heatproof temperature of Comparative Example 6 is the lowest among the toners of Examples 1 to 10 and Comparative Examples 1 to 7.

From the above results, it is clear that the toner of Comparative Example 6 which uses the copolymer 13 having a glass transition temperature much lower than 60° C. and an acid value of less than 0.5 mgKOH/g, is poor in heat-resistant storage stability and poor in printing durability under the temperature and humidity environments from the low temperature and low humidity environment to the high temperature and high humidity environment.

Next, the toner of Comparative Example 7 will be discussed. According to Tables 1 and 2, the toner of Comparative Example 7 contains the copolymer 14 composed of methyl methacrylate and n-butyl acrylate. According to Table 1, the copolymer 14 has a glass transition temperature (Tg) of 76.3° C., an acid value of 0 mgKOH/g, and a weight average molecular weight (Mw) of 10,200.

According to Table 2, as for the toner of Comparative Example 7, the number of continuously printed sheets in the printing durability test is 17,000 under the normal temperature and normal humidity (N/N) environment. Therefore, the toner of Comparative Example 7 has no problem with at least printing durability under the normal temperature and normal humidity (N/N) environment.

However, as for the toner of Comparative Example 7, the heatproof temperature is as low as 54° C., and the numbers of continuously printed sheets in the printing durability test are 10,000 under the low temperature and low humidity (L/L) environment, 8,000 under the high temperature and high humidity (H/H) environment, and 12,000 under the normal temperature and normal humidity (N/N) environment after being left at the high temperature.

From the above results, it is clear that the toner of Comparative Example 7 which uses the copolymer 14 containing no acrylic acid monomer unit and having an acid value of less than 0.5 mgKOH/g, is poor in heat-resistant storage stability and poor in printing durability especially under the low temperature and low humidity environment and the high temperature and high humidity environment.

Meanwhile, according to Tables 1 and 2, each of the toners of Examples 1 to 10 contains any one of the copolymers of 1 to 8 as the retention aid, which are copolymers of acrylic acid ester, methacrylic acid ester, and acrylic acid or methacrylic acid. Each of the copolymers 1 to 8 has a glass transition temperature of 65.5 to 76.0° C., an acid value of 0.8 to 5.9 mgKOH/g, and a weight average molecular weight Mw of 7,500 to 35,000.

According to Table 2, as for the toners of Examples 1 to 10, the heatproof temperature is as high as 57° C. or more; the minimum fixing temperature is as low as 130° C. or less; and the number of continuously printed sheets in the printing durability test is as large as 18,000 or more under all of the low temperature and low humidity (L/L) environment, the normal temperature and normal humidity (N/N) environment, the high temperature and high humidity (H/H) environment, and the normal temperature and normal humidity (N/N) environment after being left at the high temperature.

Therefore, it is clear that the toner of the present invention that contains the retention aid which is the copolymer of acrylic acid and/or methacrylic acid and acrylic acid ester and/or methacrylic acid ester and which has an acid value of 0.5 to 7 mgKOH/g, a weight average molecular weight Mw of 6,000 to 50,000, and a glass transition temperature of 60 to 85° C., has an excellent balance between heat-resistant storage stability and low-temperature fixability and is able to exhibit excellent printing durability under all of the high temperature and high humidity (H/H) environment, the normal temperature and normal humidity (N/N) environment and the low temperature and low humidity (L/L) environment.

The invention claimed is:

1. A toner for developing electrostatic images, comprising colored resin particles containing a binder resin, a colorant, a softening agent and a copolymer, and an external additive, wherein the copolymer consists essentially of units of at least one of acrylic acid ester and methacrylic acid ester and at least one of acrylic acid and methacrylic acid, and wherein the copolymer has an acid value of 0.5 to 7 mg KOH/g, a weight average molecular weight Mw of 6,000 to 50,000, and a glass transition temperature of 60 to 85° C.

2. The toner for developing electrostatic images according to claim 1, wherein a content of the copolymer is 0.5 to 4 parts by mass, with respect to 100 parts by mass of the binder resin.

3. The toner for developing electrostatic images according to claim 1, wherein the softening agent is a monoester compound which has a structure represented by the following formula (1) and a melting point of 60 to 75° C.:

$$R^1—COO—R^2 \qquad \text{Formula (1)}$$

wherein $R^1$ is a straight-chain alkyl group having 15 to 21 carbon atoms, and $R^2$ is a straight-chain alkyl group having 16 to 22 carbon atoms.

4. The toner for developing electrostatic images according to claim 3, wherein the monoester compound has an acid value of 1.0 mg KOH/g or less and a hydroxyl value of 10 mg KOH/g or less.

* * * * *